US005325540A

United States Patent [19]

Kronenberger

[11] Patent Number: 5,325,540

[45] Date of Patent: Jul. 5, 1994

[54] HEADWEAR PIECE WITH CROWN OPENING

[75] Inventor: Robert A. Kronenberger, Deerfield, Ill.

[73] Assignee: American Needle, Buffalo Grove, Ill.

[21] Appl. No.: 984,466

[22] Filed: Dec. 2, 1992

[51] Int. Cl.[5] ..... A42B 1/04

[52] U.S. Cl. ..... 2/209.3; 2/12; 2/195.1; D2/896

[58] Field of Search ..... 2/7, 12, 15, 171, 171.1, 2/195, 209.3, 209.4, 209.7, DIG. 1; D2/244

[56] References Cited

U.S. PATENT DOCUMENTS

| | | | |
|---|---|---|---|
| D. 64,441 | 4/1924 | Cavell | D2/244 |
| 1,563,611 | 12/1925 | Cohen | 2/209.3 |
| 1,665,750 | 4/1928 | McKee | 2/195 |
| 1,907,709 | 5/1933 | Barrow | 2/171 |
| 2,185,306 | 1/1940 | Marks | 2/209.3 |
| 2,207,907 | 7/1940 | Wittcoff | 2/209.3 |
| 2,883,669 | 4/1959 | Rafowitz | 2/195 |
| 4,556,993 | 12/1985 | Okamura | 2/12 |
| 4,741,053 | 5/1988 | Okamura | 2/12 |

*Primary Examiner*—Clifford D. Crowder
*Assistant Examiner*—Diana L. Biefeld
*Attorney, Agent, or Firm*—Wood, Phillips, Van Santen, Hoffman & Ertel

[57] ABSTRACT

A headwear piece with a crown for placement on the head of a wearer and having a front and rear and a top and bottom. The crown grips the head of the wearer to maintain the headwear piece in place. The crown has a front wall with a forwardly facing surface. The front wall blends into a top wall that extends rearwardly and terminates at an edge that bounds an opening in the crown through which a substantial portion of a wearer's head can be exposed with the headwear piece in place on a wearer's head. The top wall edge extends from the front of the crown no more than two-thirds, and more preferably no more than one-half, the distance between the front and the rear of the crown.

10 Claims, 2 Drawing Sheets

FIG. 6
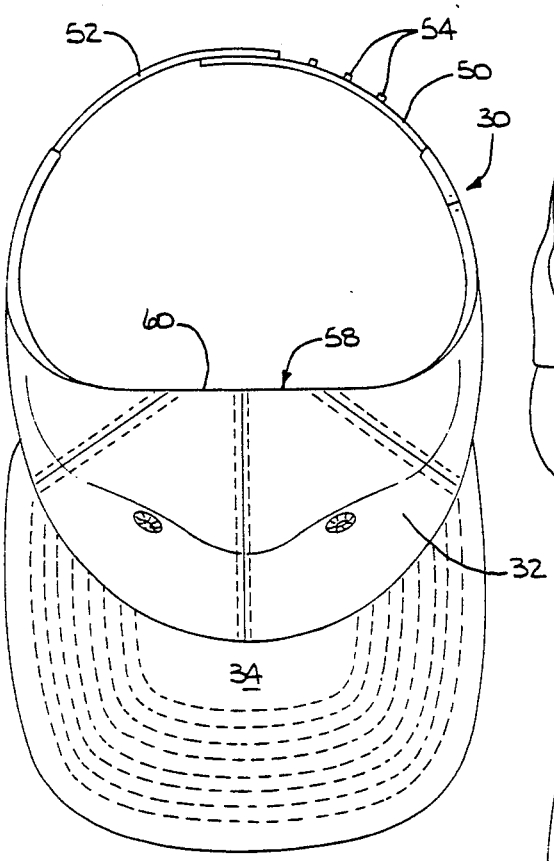
FIG. 8
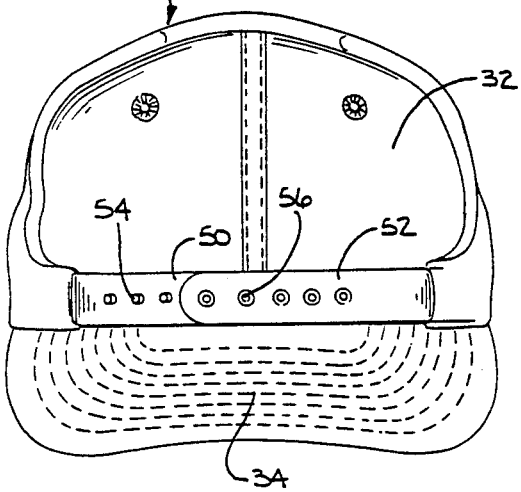
FIG. 7
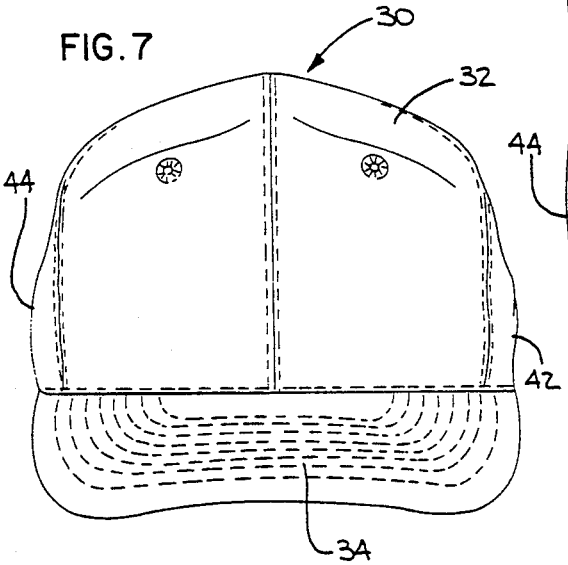
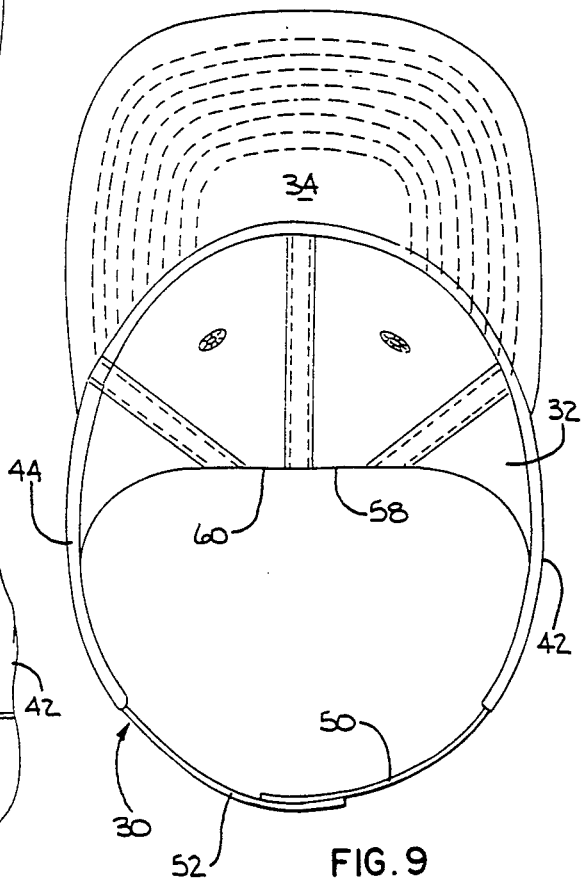
FIG. 9

HEADWEAR PIECE WITH CROWN OPENING

BACKGROUND OF THE INVENTION

Field of the Invention

This invention relates to headwear and, more particularly, to a headwear piece with a crown opening through which a substantial portion of a wearer's head is exposed.

Background Art

Baseball-style caps are one of the most widely used type of headgear, both in the active participation of sports and on a casual basis. The baseball-style cap is desired for its comfortable fit and light weight. A bill on the front of the crown shields the face of the wearer from sun and the elements. The head-conforming crown gives the cap an attractive appearance and affords, on the front wall thereof, a space for displaying logos, scenes and other messages, such as those used by advertisers.

Another popular headwear style is the conventional visor. The dominant portion of the visor is the front wall with an associated bill to afford the same shielding function as with a baseball-style cap. A band extends from the front wall to surround the head of a wearer to maintain the visor in place on the wearer's head. The principal advantage with the visor is that it allows exposure of a substantial portion of the wearer's head. The opening in the visor affords ventilation, which is desirable in warm weather. In addition, the wearer's hair can be passed through the visor opening, whereas it might otherwise bunch up and prevent proper seating of a baseball-style cap on the wearer's head.

One drawback with the conventional visor is that the front wall does not retain its shape as effectively as the front wall on a baseball-style cap. The front wall curves continuously into oppositely facing side walls with the front and side walls normally projecting upwardly and slightly inwardly towards the center of the crown. There is nothing on the visor to maintain the upper portion of the front and side walls in the desired, curved configuration. Instead, the upper portions of the front and side walls tend to distort and wrinkle, which detracts from the appearance of the visor and makes it less aesthetically pleasing than a baseball-style cap, particularly as viewed from the front.

A further problem with the conventional visor is that it defines only an open band to surround the head of a wearer. There is nothing, other than the friction between the band and the wearer's head, preventing the wearer's head from passing fully through the visor, which may result in uncomfortable or undesired placement of the visor on the wearer's head.

SUMMARY OF THE INVENTION

The present invention is specifically directed to overcoming the above-enumerated problems in a novel and simple manner.

More particularly, according to the invention, a headwear piece is provided with a crown for placement on the head of a wearer and having a front and rear and a top and bottom. The crown grips the head of the wearer to maintain the headwear piece in place. The crown has a front wall with a forwardly facing surface. The front wall blends into a top wall that extends rearwardly and terminates at an edge that bounds an opening in the crown through which a substantial portion of a wearer's head can be exposed with the headwear piece in place on the wearer's head. The top wall edge extends from the front of the crown no more than two-thirds, and more preferably no more than one-half, the distance between the front and the rear of the crown.

With the above structure, the crown opening, that has heretofore been peculiar to a visor construction, is afforded while allowing the crown to be configured to be shape-retentive in the same manner as a baseball-style cap.

This shape retaining ability is achieved, in one form, by having the front wall and top wall blend into laterally oppositely facing side walls. The front, top, and side walls are mutually reinforcing. At the same time, the top wall can be extended sufficiently towards the rear of the crown to provide an abutting surface to engage the wearer's head with the headwear piece properly positioned thereon.

The side wall height may progressively diminish between the front and rear of the crown or may be abruptly reduced.

To grip a wearer's head, the crown may be configured to define a band which extends through 360° to positively engage the head of the wearer. The effective diameter of the band may be varied to accommodate different size wearer heads.

While many different configurations are contemplated by the invention, one preferred form has the headwear piece configured as a baseball-style cap, to include a flexible fabric crown with a bill projecting forwardly therefrom.

The crown opening, as viewed from overhead, may take a number of different shapes. Exemplary shapes are a kidney-shaped opening and a semi-circularly shaped opening.

The invention further contemplates a headwear piece having a crown with a front wall with a forwardly facing surface. The front wall blends into a top wall having a downwardly facing surface. There is an opening in the crown through which a substantial portion of a wearer's head is exposed through the top of the crown with the headwear piece in place on the wearer's head.

The top wall extends from the front of the crown no more than two-thirds, and preferably no more than one-half, the distance between the front and rear of the crown.

In one form, the top wall and front wall blend into laterally oppositely facing side walls and with the headwear piece viewed in front elevation, at least one of the front wall and side walls fully obstruct viewing of the crown opening. In the event that the headwear piece is constructed as a baseball-style cap, with this construction, the headwear piece can be made to be indistinguishable from a conventional baseball-style cap when viewed from the front.

In one form, the band has a vertical dimension that is no more than ⅓ the distance between the top and bottom of the crown at the rear of the crown and the band blends into the side walls so that, as viewed from the side of the headwear piece, the vertical dimension of the opening increases from the front towards the rear of the crown.

BRIEF DESCRIPTION OF THE DRAWINGS

FIG. 6 is a plan view of the inventive headwear piece;

FIG. 7 is a front elevation view of the inventive headwear piece;

FIG. 8 is a rear elevation view of the inventive headwear piece; and

FIG. 9 is a bottom view of the inventive headwear piece.

DETAILED DESCRIPTION OF THE DRAWINGS

Figure 4:
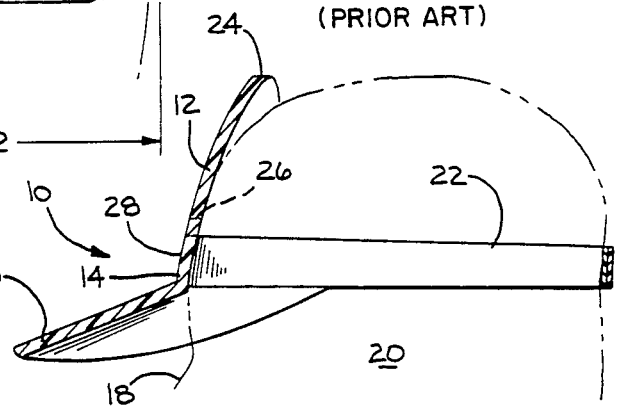
FIG. 4 (PRIOR ART)
FIG. 4 is a cross-sectional view of a conventional visor in place on a wearer's head.

In FIG. 4, a conventional visor is shown at 10. The visor has a front wall 12 extending typically through less than 180° around the front of the wearer's head. The lower edge 14 of the front wall 12 is secured to a bill 16 that projects downwardly and forwardly therefrom to afford a shield over the face 18 of a wearer 20. A band 22 connects to at least one of the front wall 12 and bill 16 to define therewith a structure that extends 360° around the head of the wearer 20 to thereby frictionally hold the visor 10 in place on the wearer's head.

It is desirable that the front wall 12 maintain a predetermined curvature which is generally loosely matched to the front of the wearer's head. At the juncture between the front wall lower edge 14 and bill 16, the front wall edge 14 is reinforced and maintained at the desired curvature. However, the top edge 24 of the front wall 12 is unsupported and therefore "floppy". Typically the front wall 12 is made from flexible material, such as fabric, which readily collapses, wrinkles and otherwise deforms. The front wall 12 may thus have an unsightly appearance after the hat is crushed or even when simply fit to an unusually shaped head.

One alternative to having a floppy front wall 12 is to reduce the vertical dimension thereof. For example, it is known to construct visors with a front wall that has a vertical dimension similar to that for the band 22. The front wall 12 shown in FIG. 4 can thus be cut off where indicated by the dotted line 26. With this construction, the front wall 12 remains fairly rigid, however, the forwardly facing surface 28 becomes so small that it is virtually unusable to display a logo, message, advertising, etc.

The inventive headwear piece is shown in detail in FIGS. 1-3 and 5-9 at 30. The headwear piece 30 has a crown 32 with a bill/rim 34 projecting forwardly and slightly downwardly therefrom.

The crown 32 is defined by a plurality of flexible fabric panels 36, which are sewn together so as to define a front wall 38 that curves rearwardly to blend into a top wall 40, with the front wall 38 and top wall 40 blending into laterally oppositely facing side walls 42, 44.

The crown 32 has a band 46 that is either a self-contained loop or which, in conjunction with the panels 36, extends through 360° around the head of a wearer to grip the head of a wearer to maintain the headwear piece in place on the wearer's head. The band 46 has a means at 48 to vary the effective diameter thereof. The means 48 is conventional in construction and consists of overlapping straps 50, 52, with there being spaced studs 54 on the strap 50 which are snapped into receptacles 56 on the strap 52 so as to maintain a desired overlap of the straps 50, 52. By varying the extent of overlap, the effective diameter of the band 46 is likewise varied.

According to the invention, the crown 32 defines an opening 58 through which a substantial portion of a wearer's head is exposed with the headwear in place. As seen in FIG. 6, the opening 58 is kidney-shaped or semicircular when viewed from overhead.

One significant feature of the present invention is the relationship of the front wall 38, top wall 40, and side walls 42, 44 of the crown 32 to the opening 58. The top wall 40 terminates at an edge 60 that bounds the opening 58. The edge 60 is spaced from the front of the crown a distance D1 (see FIG. 3). In a preferred form, the spacing of the edge 60 from the front of the crown 32, as designated by the distance D1, is no more than two-thirds, and preferably no more than one-half, the distance D2 between the front and rear of the crown 32. This produces a substantial opening size to afford substantial ventilation and comfortably accommodate the wearer's hair.

The front wall 12, top wall 40 and side walls 42, 44 reinforce each other to maintain the shape of the headwear piece at the front thereof. As seen most clearly in FIG. 7, the headwear piece 30 is indistinguishable from a normal baseball-type cap without the opening 58, as viewed from the front thereof. The front wall 12, on which messages, decorations, advertisements, etc. are placed, consistently maintains the configuration shown in FIG. 7, as with the conventional baseball-style cap. Thus, all the advantages of a baseball-style cap are realized, together with the advantages of the conventional visor.

Figure 1:
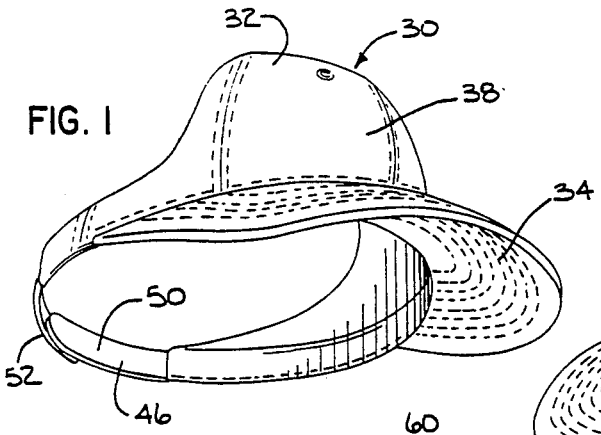
FIG. 1 is a front, bottom and side perspective view of a headwear piece according to the present invention.
Figure 2:
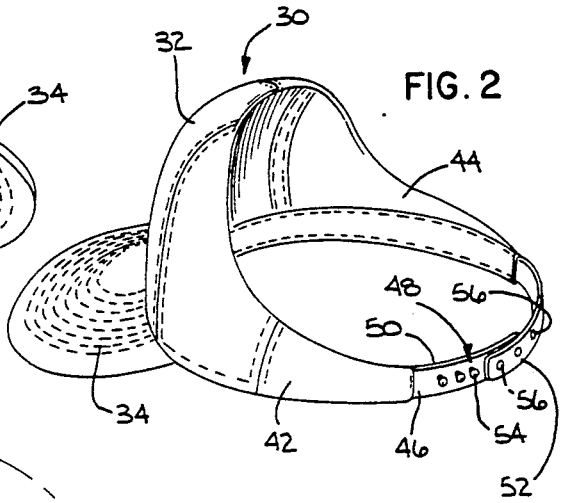
FIG. 2 is a top, rear and side perspective view of the headwear piece in FIG. 1.
Figure 3:
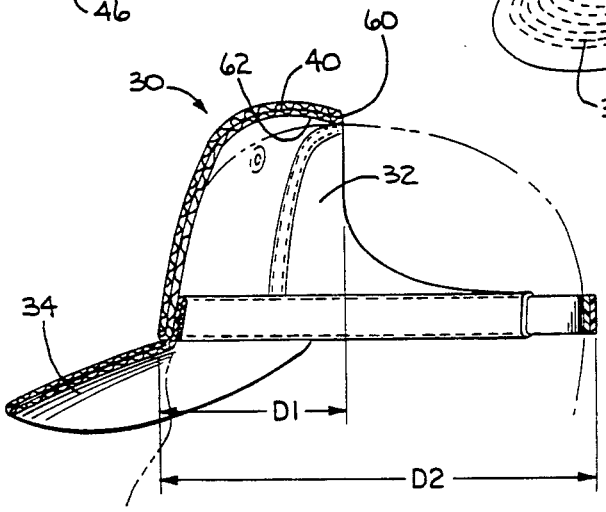
FIG. 3 is a cross-sectional view of the headwear piece in FIGS. 1 and 2 in place on the head of a wearer.

In addition to the shape-retentive capability of the front portion of the headwear piece 30, the top wall 40 defines a downwardly facing surface 62 to abut a wearer's head, as shown in FIG. 3, to arrest downward movement of the headwear piece 30 relative to the wearer's head.

Figure 5:
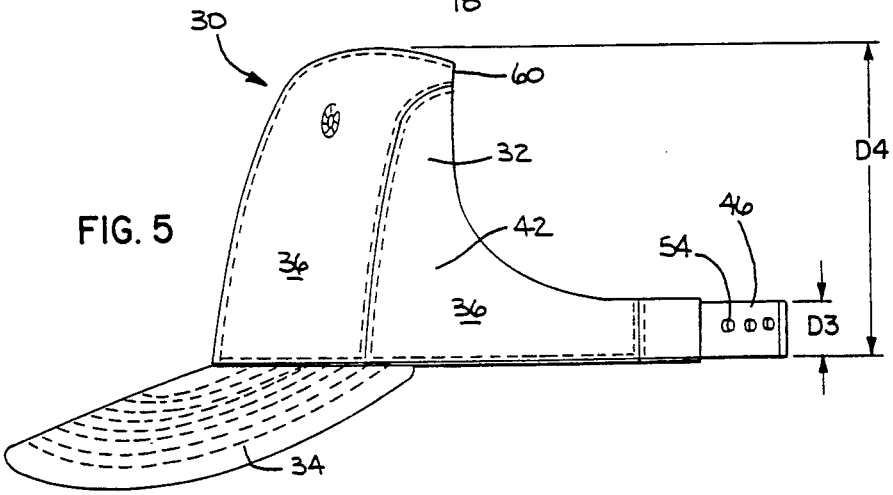
FIG. 5 is an enlarged, side elevation view of the inventive headwear piece.

As seen clearly in FIG. 5, the side wall 42, as well as the other side wall 44 which is not shown, diminish in height progressively away from the top wall edge 60 towards the rear of the headwear piece 30 to blend into the band 46. The band 46 has a vertical dimension D3 at its rear edge that is preferably no more than ⅓ the overall height of the crown 32, as indicated by D4 in FIG. 5. This provides a very significant opening to minimize interference between the wearer's hair and the headwear piece 30 as well as affording good ventilation. While the vertical dimension of the side walls 42, 44 is shown to progressively diminish, it could be abruptly reduced at or near vertical coincidence with the edge 60.

It should be understood that the inventive concept is not limited to a baseball-style cap. Any crown might be similarly constructed. For example, a cap with a surrounding rim might employ the same concept. The invention is particularly suitable to crowns having a flexible construction, such as the baseball-style cap that is made from fabric.

The foregoing disclosure of specific embodiments is intended to be illustrative of the broad concepts comprehended by the invention.

I claim:

1. A baseball-style headwear piece comprising:

a crown for replacement on the head of a wearer and having a front and rear and a top and bottom, said crown being defined at least in part by first and second panels defined at least in part from a flexible fabric and joined to each other;

a bill on the headwear piece projecting forwardly of the crown, there being means on the crown for gripping the head of a wearer to maintain the headwear piece in place on a wearer's head, said crown having a front wall with a forwardly facing surface, said front wall blending into a top wall that is angularly disposed to the front wall, extends rearwardly and terminates at an edge that bounds an opening in the crown through which a substantial portion of a wearer's head can be exposed with the headwear piece in place on a wearer's head, said top wall having at least a portion that extends substantially horizontally to abut to a wearer's head to maintain the headwear piece in a consistent location on a wearer'head, at least one of said first and second panels being preformed into a shape to define a portion of the front and top wall and joined to the other of the first and second panel along a vertical seam so that the other of the first and second panels retains the preformed shape of the one of the first and second panels, said front wall curving into laterally spaced side walls, said front wall, top wall, and side walls being configured to cause the appearance of the headwear piece from the front thereof to be substantially the same as that of a conventional baseball-style cap, said top wall edge extending from the front of the crown no more than one half the distance between the front and rear of the crown.

2. The headwear piece according to claim 1 wherein the gripping means comprises a band defined by said crown extending through 360° to engage the head of a wearer.

3. The headwear piece according to claim 2 wherein there are means on the crown to vary the effective diameter of the band to accommodate different size wearer heads.

4. The headwear piece according to claim 1 wherein the height of at least one of the side walls diminishes rearwardly away from the top wall edge.

5. The headwear piece according to claim 1 wherein the crown opening is at least one of a kidney shape and a semi-circle as viewed from the top of the crown.

6. The headwear piece according to claim 1 wherein with the headwear piece viewed in front elevation at least one of the front wall and side walls fully obstructs viewing of the crown opening.

7. The headwear piece according to claim 1 wherein the gripping means includes a band and the band has a vertical dimension that is no more than one third the distance between the top and bottom of the crown at the rear of the crown and the band blends into the side walls so that, as viewed from the side of the headwear piece, the vertical dimension of the opening decreases from the rear towards the front of the crown.

8. The headwear piece according to claim 1 wherein the first and second panels are joined along a line extending vertically along the front wall and the top wall.

9. The headwear piece according to claim 8 wherein the vertically extending line is located approximately midway between the laterally spaced side walls.

10. The headwear piece according to claim 1 wherein there are at least three panels defining the front wall and the side walls.

* * * * *